United States Patent [19]

Smith

[11] 4,383,646

[45] May 17, 1983

[54] SNOW MAKING NOZZLE

[76] Inventor: Fergus S. Smith, P.O. Box A, South Londonderry, Vt. 05155

[21] Appl. No.: 208,380

[22] Filed: Nov. 19, 1980

[51] Int. Cl.[3] ..... F25C 3/04

[52] U.S. Cl. ..... 239/14; 239/422; 239/430; 239/433

[58] Field of Search ..... 239/2 S, 14, 428, 430, 239/433, 422; 62/74

[56] References Cited

U.S. PATENT DOCUMENTS

| | | | |
|---|---|---|---|
| 1,285,952 | 11/1918 | De Ros | 239/422 |
| 1,462,680 | 7/1923 | Bliss | 239/430 |
| 3,266,552 | 8/1966 | Denis | 239/430 |
| 3,601,318 | 8/1971 | Gehring | 239/430 |
| 4,145,000 | 3/1979 | Smith et al. | 239/14 |

FOREIGN PATENT DOCUMENTS

| | | | |
|---|---|---|---|
| 52-73202 | 6/1977 | Japan | 239/430 |

*Primary Examiner*—John J. Love
*Assistant Examiner*—Michael J. Forman
*Attorney, Agent, or Firm*—Jones, Tullar & Cooper

[57] ABSTRACT

A snow making nozzle in which streams of water impinge on each other to atomize the water and to direct the water out of the nozzle with the assistance of compressed air to spray the atomized water into the atmosphere to make snow is disclosed. The nozzle uses opposed groups of water outlet ports carried in nozzle plates. These water outlet ports are angled toward the outlet of the nozzle and are located at the venturi of a converging-diverging nozzle with each water outlet port in the upper plate being directly opposite from a corresponding water outlet port in the lower plate so that the water streams from cooperating ports directly contact each other. Impingement of these streams with each other provides superior water atomization which takes place without contacting the body of the nozzle. The inclination of the water outlet ports increases the operating efficiency of the snow making nozzle and allows more snow production per unit of energy than prior art devices.

1 Claim, 3 Drawing Figures

SNOW MAKING NOZZLE

FIELD OF THE INVENTION

The present invention is directed generally to a snow making nozzle assembly. More particularly, the present invention is directed to a snow making nozzle assembly which utilizes impingement of streams of water to achieve atomization of the water. Most specifically, the present invention is directed to a snow making nozzle assembly in which the impinging streams of water are directed at each other from water outlets angled at generally 45° in the direction of the outlet of the nozzle and with the outlets located at the venturi of a converging-diverging nozzle. The streams of water which issue from corresponding water outlets in the two disk-shaped nozzle plates which form the nozzle strike each other in the space between the plates to cause atomization of the water. Compressed air contacts the atomized water in the nozzle to further atomize it and to assist in blowing the water out of the nozzle into the ambient air whose temperature is below 32° F. where it freezes and forms snow. Since the water outlets are angled in the plates in the direction of the nozzle outlet and exit the nozzle plates at the venturi of the converging-diverging nozzle, more atomization is accomplished within the body of the nozzle and the atomized water particles are directed out of the nozzle. This angling of the water outlet ports increases the efficiency of operation of the snow making nozzle and facilitates the more efficient production of useable, dry snow.

DESCRIPTION OF THE PRIOR ART

The present invention is an improvement of the snow making nozzle assembly set forth in my prior U.S. Pat. No. 4,145,000.

As discussed in detail in my prior patent, the use of atomizing nozzles generally is known in the art particularly in the field of oil burners and the like where it is desirable to provide a spray of atomized fuel oil so that combustion may proceed efficiently. Such nozzles structures would not, however, be useful in the production of man made snow.

As was also discussed in some detail in my prior patent, a large number of patents have issued which are all directed to the problem of making good man made snow in an effective and efficient manner. The types of structures which have been patented are very diverse. All, of course, utilize water which is dispersed into the atmosphere to freeze and fall to the ground as snow or particles of ice which attempt to approximate snow. Some of these patents use internal mixing of water and compressed air, some use external mixing, some project the water into a current of air produced by an auxiliary fan and others produce seed crystals of ice which are intended to be nucleai for the formation of snow. Although very diverse in approach, all the prior art patents have the objective of producing man made snow which can be used to augment, or as substitution for natural snow on ski slopes, trails, jumps, and the like. All strive to produce as natural a snow as possible, in any weather where the ambient temperature is below 32° F., and in an efficient manner in terms of energy requirements.

In my prior patent, there is disclosed a snow making nozzle assembly in which groups of water ports are formed in nozzle plates and are positioned so that streams of water passing through these ports impinge on each other for atomization. These water outlet ports are generally at right angles to the body of the nozzle and are located in the diverging portion of the converging-diverging nozzle. While the nozzle assembly disclosed in my prior patent has been very successful and produces snow in a manner which is better than a number of the prior art devices, several shortcomings and areas in which improvement is desirable have been noted.

Since the outlet ports in my prior nozzle are generally vertical, if the water flow is established before the air flow, there is a possibility of water flow into the body of the nozzle and into the compressed air line where problems of icing can result. The water ports are quite near the edge of the nozzle so that some atomization takes place in the atmosphere instead of in the body of the nozzle. The placement of the water outlet ports at generally 90° to the axis of the nozzle does not aid in the efficient operation of the nozzle since the direction of travel of the liquid streams and of the atomized water particles is generally perpendicular to the direction of flow of the compressed air. The snow making nozzle described in my prior patent also operates efficiently over a limited range of water and air pressures and flow rates which places an upper limit on the amount of snow which can be produced. While my prior snow making nozzle is far more efficient than prior art devices in the production of usable snow, it has been found in actual usage that my prior art snow making nozzle assembly has several areas where structural changes will greatly improve the efficiency of the assembly and its ability to produce good, usable snow.

SUMMARY OF THE INVENTION

It is accordingly an object of the present invention to provide an improved snow making nozzle assembly.

Another object of the present invention is to provide a snow making nozzle assembly which is more efficient than prior art devices.

A further object of the present invention is to provide a snow making nozzle assembly of the internal atomization type.

Yet another object of the present invention is to provide a snow making nozzle assembly which is usable over a wide range of ambient air temperatures.

The snow making nozzle in accordance with the present invention is generally similar to the snow making nozzle assembly shown in my prior U.S. Pat. No. 4,145,000. The nozzle assembly of the present invention is comprised generally of a pair of disk-shaped plates which have a generally flat, fan shaped converging-diverging nozzle formed by cut out portions of the plates. This nozzle extends generally from the center to the periphery of the plates with the nozzle outlet subtending an arc of less than 90°. A plurality of equally spaced water outlet ports are spaced in the nozzle and are inclined at approximately 45° to the axis of the nozzle. Corresponding water outlet ports are formed in each of the disk sections. Water is supplied to these outlet ports through flow channels in the disk-shaped body portions and these streams of water impinge on each other to atomize. The atomized water is then blown out into the ambient atmosphere by compressed air where, assuming a suitably low ambient air temperature; i.e. below 32° F., the water freezes to form snow.

The water outlet ports on the snow making nozzle assembly in accordance with the present invention are angled toward the outlet of the nozzle at approximately 45° to the axis of the nozzle, and to the plates, and exit the plates at the venturi of the nozzle. If water flow is started before compressed air flow, the water will not flow into the nozzle and the air inlet to cause icing problems. The inclination of the ports aids in causing movement of the atomized water out of the nozzle assembly. This inclination of the water ports also has an aspirating or suction effect on the air line thus improving the efficiency of operation of the snow making nozzle assembly.

The inclination of the water outlet ports of the snow making nozzle facilitates use of water at higher pressures and greater flow rates than in my prior device. Since water flow into the air lines is prevented and since the water flow is directed outwardly of the nozzle, the nozzle assembly can operate at low temperatures without fear of icing or choking. The increased rate of water flow afforded by the inclined water outlet ports prevents ice formation since it is the heat of the water and the frictional heat generated by the water flow which prevents ice formation. Because the snow making nozzle in accordance with the present invention uses increased water flow volumes, it can function ice free at lower temperatures than prior art devices. The increased water pressures and flow rates at which the snow making nozzle assembly can be operated and the inclination of the water outlet ports also decreases compressed air requirements since the increased water pressures promotes better discharge of the water and more complete atomization. The increased water pressure also facilitates a greater projection distance of the atomized water to cover larger areas with snow than is possible with prior art devices and also enhances ambient cooling since the atomized water is discharged over a larger area.

The snow making nozzle assembly in accordance with the present invention is easy to operate, is not susceptible to problems of icing or choking, is rugged and durable since it has no moving parts, and is efficient in its production of high quality, dry snow while not using large amounts of energy.

BRIEF DESCRIPTION OF THE DRAWINGS

While the novel features of the snow making nozzle assembly in accordance with the present invention are set forth with particularity in the appended claims, a full and complete understanding of the invention may be had by referring to the description of a preferred embodiment as set forth hereinafter and as may be seen in the accompanying drawings in which:

DESCRIPTION OF A PREFERRED EMBODIMENT

Figure 1:
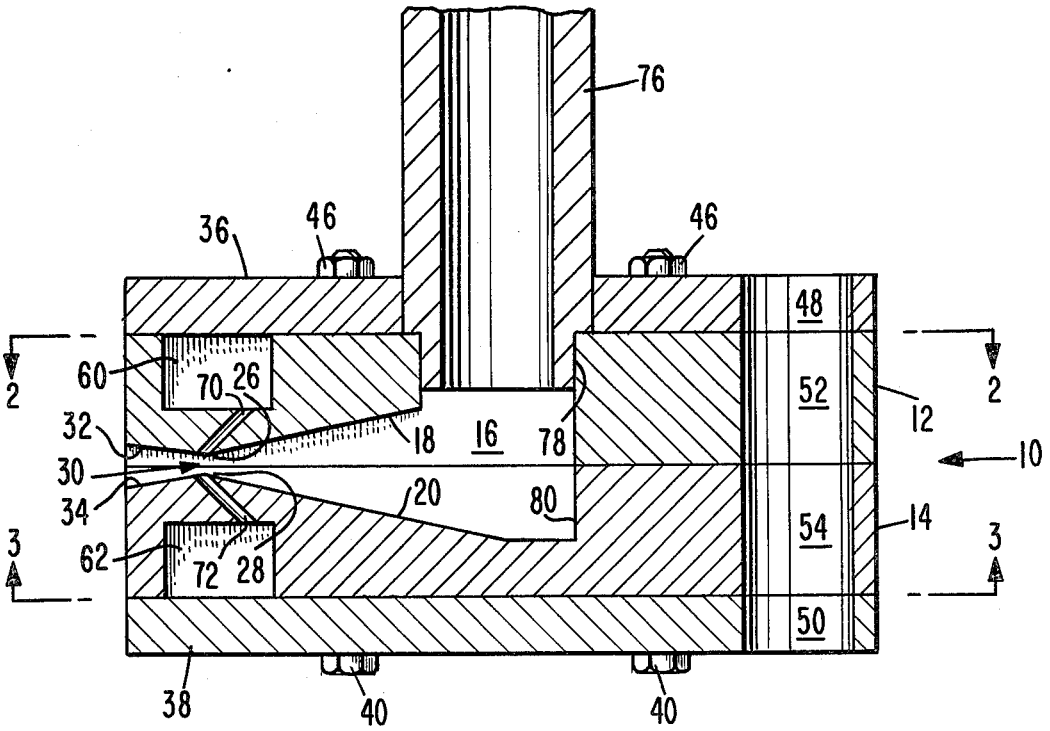
FIG. 1 is a cross-sectional side elevation view of the snow making nozzle assembly in accordance with the present invention.

Turning initially to FIG. 1, there may be seen, generally at 10, a preferred embodiment of a snow making nozzle assembly in accordance with the present invention. As may be seen, nozzle assembly 10 is formed by an upper nozzle plate 12 and a lower nozzle plate 14. Nozzle plates 12 and 14 are, as may be seen in FIGS. 2 and 3, respectively both generally flat, disk-shaped elements. As may also be seen in FIG. 1 and in the dashed lines in FIGS. 2 and 3, the nozzle plates 12 and 14 have portions removed to form a converging-diverging nozzle generally at 16. Nozzle 16 is generally fan shaped in plan view, as may also be seen by the dashed lines in FIGS. 2 and 3, and extends radially outwardly from the centers of the nozzle plates 12 and 14 to their peripheries. While the nozzle 16 is shown as subtending an arc of less than 90 degrees, it will be understood that the angle of the nozzle could be varied, if desired.

Referring again to FIG. 1, nozzle 16 has a converging-diverging shape in cross-section with the upper and lower nozzle plates 12 and 14 having upper and lower converging wall sections 18 and 20, respectively extending radially outwardly from the centers 22 and 24 of the upper and lower nozzle plates 12 and 14, respectively. The converging wall sections 18 and 20 terminate at apexes 26 and 28 which cooperate to form a venturi 30 of the nozzle. From there, the nozzle 16 diverges with diverging wall sections 32 and 34 being formed on the upper and lower nozzle plates 12 and 14, respectively. This structure of the nozzle plates 12 and 14 and of nozzle 16 is similar to the structure shown in my prior U.S. Pat. No. 4,145,000.

An upper cover plate 36 is positioned above upper nozzle plate or disk 12 and a lower cover plate 38 is positioned beneath lower nozzle plate or disk 14. These cover plates are held in place by suitable bolts 40 which pass through apertures (not shown) in the cover plates and corresponding apertures 42 and 44 in the upper and lower nozzle plates 12 and 14, as may be seen in FIGS. 2 and 3, respectively. Suitable nuts 46 are used to secure the assembly together. It will be understood that gaskets or gasket forming materials may be applied between the cover plates and nozzle plates in a known manner to provide an assembly which does not leak. As may also be seen in FIGS. 1-3, larger mounting apertures 48 and 50 are provided in the upper and lower cover plates 36 and 38 and corresponding mounting apertures 52 and 54 are provided in the upper and lower nozzle plates 12 and 14, respectively. When snow making nozzle assembly 10 is assembled, these mounting apertures 48, 50, 52, and 54 are all aligned so that the snow making nozzle can be affixed to a suitable support such as a tripod or the like in any known manner such as, for example, by passage of a bolt through these mounting apertures, the bolt also engaging the tripod or other support. As may also be seen in FIGS. 2 and 3 alignment holes 56 and 58 are placed in upper and lower nozzle plates 12 and 14, respectively. Aligning pins (not shown) are placed in these holes as the snow making nozzle is assembled to insure that the upper and lower nozzle plates are properly positioned with respect to each other.

Figure 2:
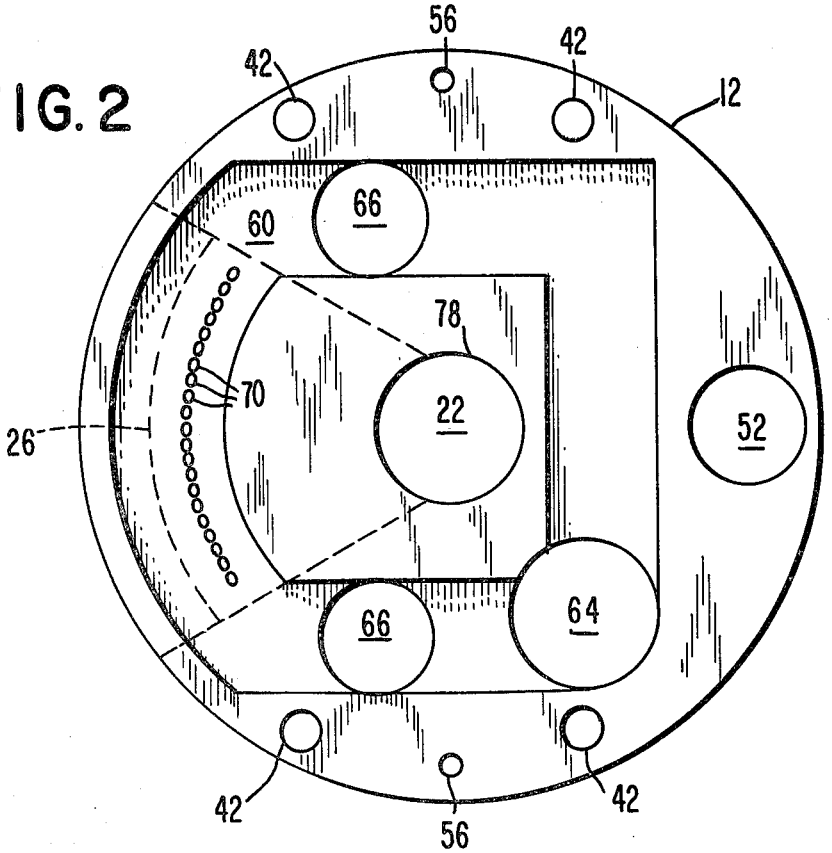
FIG. 2 is a top plan view of the upper nozzle plate of the snow making nozzle assembly of the present invention taken along line 2—2 of FIG. 1.
Figure 3:
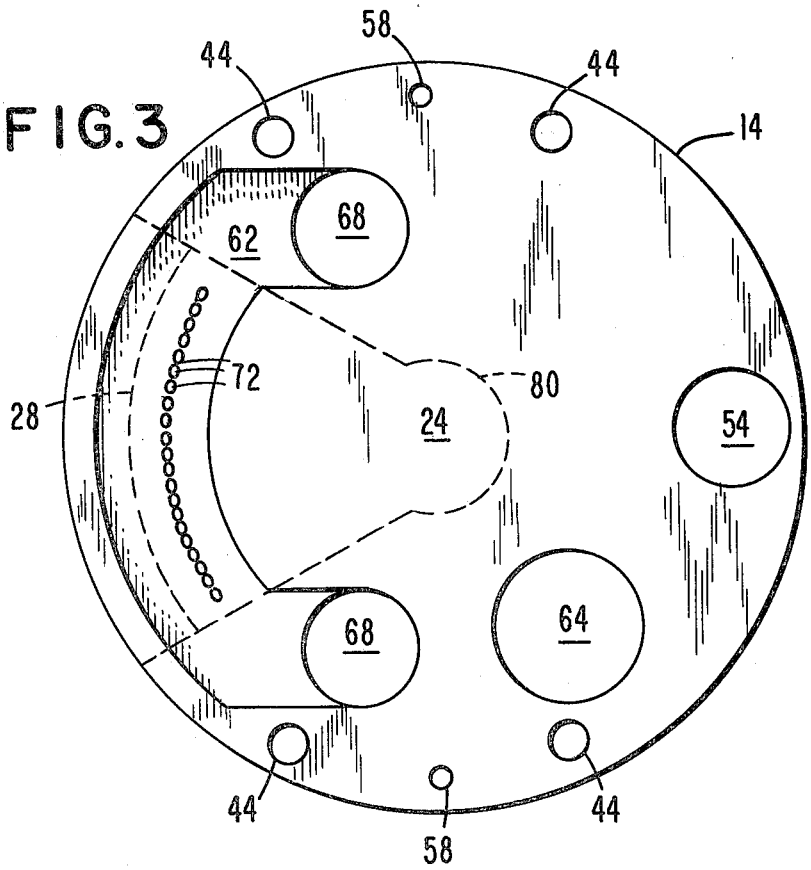
FIG. 3 is a bottom plan view of the lower nozzle plate of the snow making assembly of the present invention taken along line 3—3 of FIG. 1.

As may be seen in FIGS. 1-3, upper and lower nozzle plates 12 and 14 are provided with water distribution channels 60 and 62, respectively. As is shown more clearly in FIG. 2, upper water distribution channel 60 is generally rectangular and is formed as a recess in upper nozzle plate 12. Water enters the upper distribution channel 60 from a water inlet opening 64 that receives water from the snow making system. Any conventional fastening means and valve means may be provided to attach the water supply line to the snow making nozzle assembly 10 so that water under pressure can flow through upper water channel 60. A pair of spaced upper water passages 66 allow water to pass therethrough and into corresponding spaced lower water passages 68 in lower nozzle plate 14. These lower water passages 68 are in fluid communication with the lower water distribution channel 62 which is generally U-shaped in plan view.

Inclined water outlet ports 70 and 72 are formed in the upper and lower nozzle plates 12 and 14, respectively with each upper water outlet port 70 being positioned directly over a corresponding lower water outlet port 72. These ports are inclined at an angle of generally 45 degrees to the axis of the converging-diverging nozzle and terminate on the upper and lower apexes 26 and 28 of the plates 12 and 14, respectively, as may be seen in FIG. 1. The water outlet ports 70 and 72 are, in the preferred embodiment, 3/32 of an inch in diameter and are equally spaced from each other in the nozzle 16. They follow the curvature of the periphery of the nozzle plates and terminate in the venturi 30 of the nozzle 16 approximately ½ inch inwardly of the periphery of the nozzle plates. When water under pressure is introduced into the upper and lower water distribution channels 60 and 62, it passes through the upper and lower inclined water outlet ports 70 and 72 in a plurality of streams, each such stream from the upper plate 12 impinging on a corresponding stream from the lower plate 14 at a point equidistant from the diverging wall portions 32 and 34 of the nozzle 16. These streams, when they contact each other, act to atomize each other without contacting the wall portions of the nozzle. This atomization provides a uniform spray of finely divided particles of water which are directed out of the nozzle by the pressure and flow rate of the water.

As may also be seen in FIG. 1, a compressed air line 76 is securable in a central aperture 78 at the center 22 of the upper nozzle plate 12. A similar central aperture 80 is provided at the center 24 of the lower nozzle plate 14. Compressed air enters through the compressed air line 76, is directed to the inner portion of the nozzle 16, and passes radially outwardly through the nozzle. This compressed air contacts the atomized water being formed generally at the venturi section 30 of the nozzle, and causes further atomization of the water. This air also cooperates with the high pressure water to disperse the atomized water particles into the atmosphere in a generally fan shaped pattern away from the nozzle.

In operation, the compressed air line is connected to a suitable source of compressed air and water under pressure is delivered to the snow making nozzle assembly through passage 64. As was indicated previously, any suitable water supply line and valve assembly can be used to supply water to the nozzle assembly and similarly, any suitable compressed air line and fittings may also be used. Such water and air lines are available at ski facilities which make man made snow and these lines can be suitably adapted so that they can be connected to the snow making nozzle assembly 10 of the subject invention. Compressed air is supplied at a pressure of 50–400 psi and water is supplied at approximately the same pressure. The air is supplied at the rate of 50–500 CFM and the water at a rate of 20–200 GPM. The compressed air flow should be initiated first through line 76 into nozzle 16. The water is then fed through inlet opening 64 and flows through the upper distribution channel 60 in upper nozzle plate 12 and through the water passages 66 and 68 into the lower water distribution channel 62 in the lower nozzle plate 14. The water then passes through the spaced water outlet ports 70 and 72 in the upper and lower nozzle plates 12 and 14, respectively, into the venturi portion 30 of the converging-diverging nozzle 16. Since the water outlets 70 and 72 are correspondingly positioned on the nozzle plates, the high pressure streams of water which emanate from the water outlet ports strike each other at the middle of nozzle 16 so that atomization of the water takes place out of contact with the nozzle walls. This atomized water is then further atomized by the compressed air which carries the atomized particles out of the nozzle and into the ambient air where they freeze and form snow.

In contrast to my prior patent, in which the water outlet ports were generally vertical, the water outlet ports 70 and 72 of the subject invention are angled at generally 45 degrees to the axis of nozzle 16 and are placed further away from the periphery of the nozzle. If the water is inadvertently turned on before the air, the water which exits the outlet ports 70 and 72 will atomize because of the impingement of corresponding streams and will tend to be directed out of the nozzle 16 due to the inclination of the outlet ports 70 and 72. Flow of water into the body of the assembly and into the air inlet line 76 and the resultant formation of ice in these regions is substantially reduced or eliminated. Inclination of water outlets 70 and 72 also creates an aspiration of air through the nozzle thus causing an increase in efficiency of usage of compressed air. The problem of choking which is common with other interior mixing snow making assembles is eliminated so that higher water and compressed air rates can be used to allow more snow production in colder weather. This increased rate of water flow at higher water pressures which is facilitated by the inclined water outlet ports 70 and 72 also increases efficiency and provides increased coverage because the atomized droplets of water are projected out of the nozzle at a higher velocity.

In the preferred embodiment of the snow making nozzle assembly in accordance with the present invention, the upper and lower nozzle plates 12 and 14 are each approximately 5 inches in diameter and are ⅞ inch thick. The water outlet ports 70 and 72 are 3/32 of an inch in diameter and 21 such ports are equally spaced in an arc of approximately 60 degrees. The venturi portion 30 of nozzle 16 is approximately ½ inch in from the periphery of the nozzle plates 12 and 14 and the plates are formed from a metal such as aluminum or the like which is light weight, durable, and not apt to rust or corrode when exposed to water for long periods of time.

While a preferred embodiment of a snow making nozzle assembly in accordance with the present invention has been fully and completely described hereinabove, it will be obvious to one of skill in the art that a number of changes in, for example, the size of the nozzle plates, the number of water outlet ports, the air and water connections, and the like could be made without departing from the true spirit and scope of the invention and that the invention is to be limited only by the following claims.

I claim:

1. A snow making nozzle assembly for use in atomizing water and projecting the water into atmosphere having an ambient temperature below about 32° F. to form snow, and nozzle assembly comprising:

upper and lower nozzle plates;

plural spaced angled water outlet ports passing through said upper and lower nozzle plates with each said water outlet port in said upper plate being positioned substantially directly above and in opposition to a corresponding one of said water outlet ports in said lower plate;

upper and lower water distribution means in said upper and lower nozzle plates, said water distribution means overlying corresponding water outlet ports for supplying water under pressure to said water outlet ports;

a converging-diverging flat nozzle in said plates, said nozzle extending outwardly from a compressed air inlet at an interior portion of said plates to an elongated outlet at a peripheral portion of said plates, said water outlet ports terminating at upper and lower apexes of said upper and lower nozzle plates, said apexes forming the venturi of said converging-diverging nozzle; and, a mixing space defined by said diverging portion of said nozzle, said water outlet ports being angled toward said nozzle outlet to cause the water supplied under pressure to said upper and lower water distribution means to pass through said water outlet ports in separate streams each of which impinges on a corresponding stream from an opposed water outlet port for atomization in said mixing space out of contact with said nozzle plates, said water outlet ports further being angled sufficiently toward said nozzle outlet to direct the atomized water out from said mixing space through said nozzle outlet, and to prevent flow of the atomized water into the interior of said nozzle to thereby prevent choking of said nozzle, air under pressure passing out through said nozzle from said compressed air inlet and contacting said atomized water to atomize it further and to assist in carrying said atomized water into the atmosphere for formation of snow.

* * * * *